United States Patent [19]

Rosman et al.

[11] Patent Number: 4,535,840

[45] Date of Patent: Aug. 20, 1985

[54] INTERNALLY MANIFOLDED UNIBODY PLATE FOR A PLATE/FIN-TYPE HEAT EXCHANGER

[75] Inventors: Irwin E. Rosman, Woodland Hills; William R. Wagner, Los Angeles, both of Calif.

[73] Assignee: Rockwell International Corporation, El Segundo, Calif.

[21] Appl. No.: 375,511

[22] Filed: Apr. 30, 1982

Related U.S. Application Data

[62] Division of Ser. No. 80,877, Oct. 1, 1979, Pat. No. 4,347,896.

[51] Int. Cl.[3] ..... F28F 3/08

[52] U.S. Cl. ..... 165/167

[58] Field of Search ..... 122/367 C; 165/157, 165/165, 168, 164, 166, 170

[56] References Cited

U.S. PATENT DOCUMENTS

| | | | |
|---|---|---|---|
| 1,197,944 | 9/1916 | Munters | 165/166 |
| 2,005,515 | 6/1935 | Winkler | 165/168 |
| 2,136,153 | 11/1938 | Rosenblad | 165/165 |
| 3,830,676 | 8/1974 | Elkins | 165/46 X |

*Primary Examiner*—Sheldon J. Richter

*Attorney, Agent, or Firm*—H. Frederick Hamann; Harry B. Field

[57] ABSTRACT

An internally manifolded plate for a plate/fin-type heat exchanger comprises a side port contiguous with and transverse to at least one channel, and wherein the channel is contiguous with an end port. The plate may be of unibody construction and also include integral side and end external manifolds.

8 Claims, 33 Drawing Figures

Fig. 8a
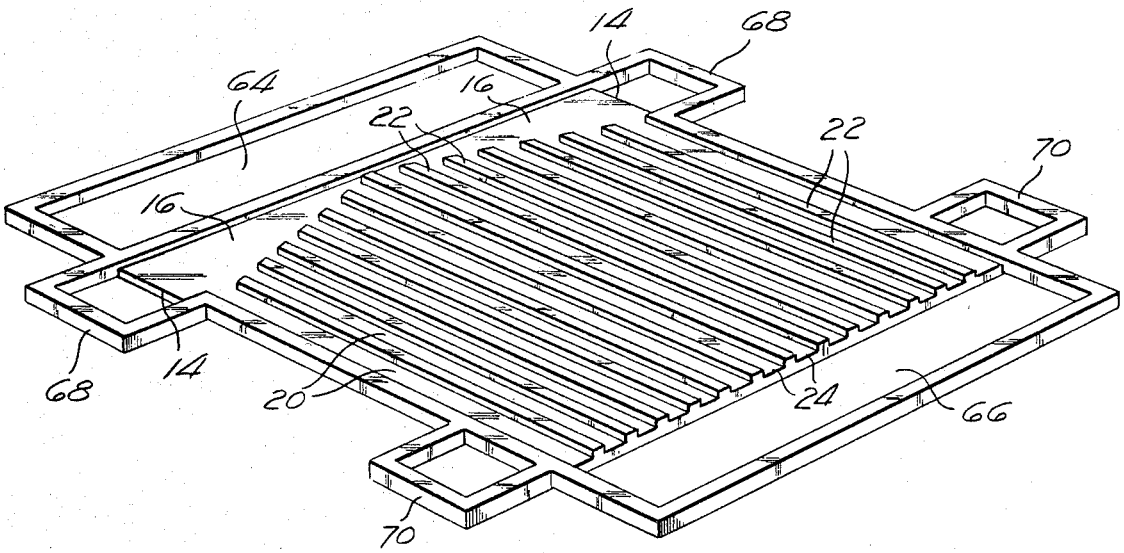
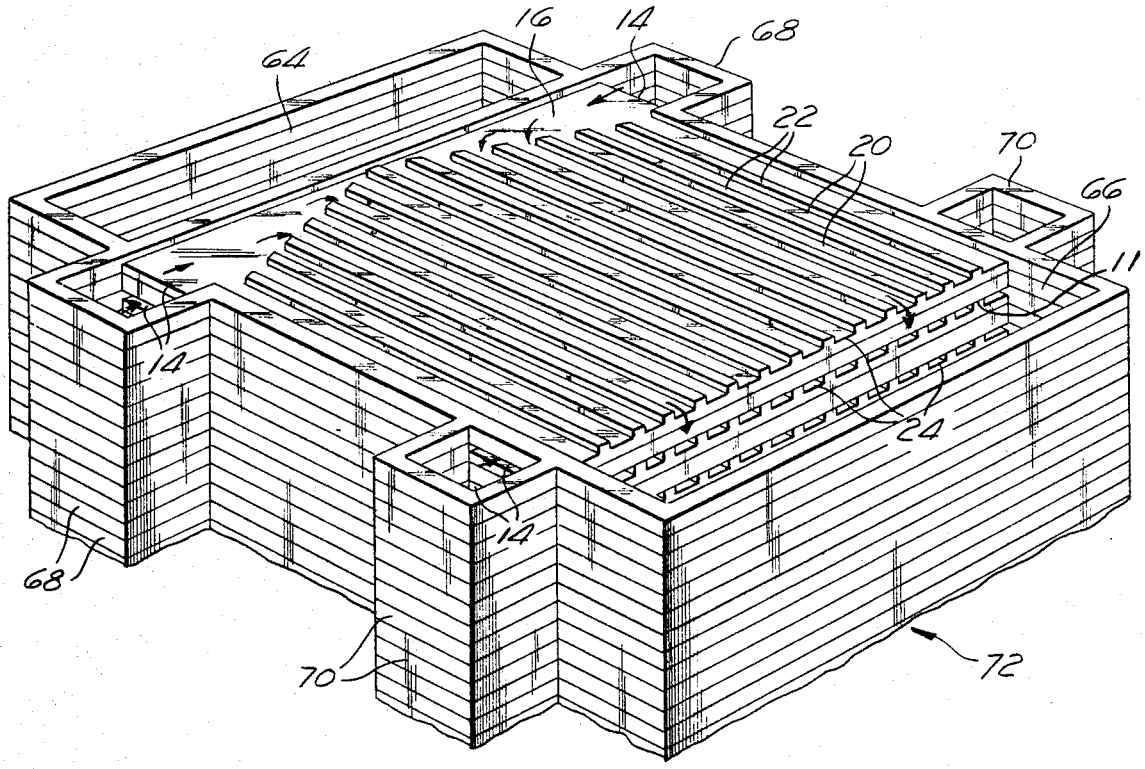
Fig. 8b

Fig. 9b
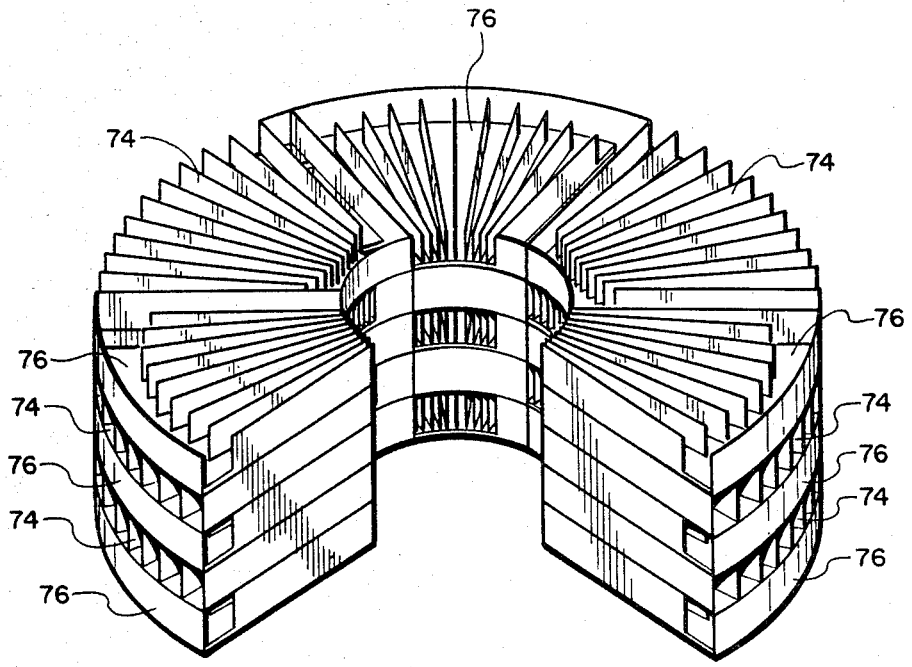
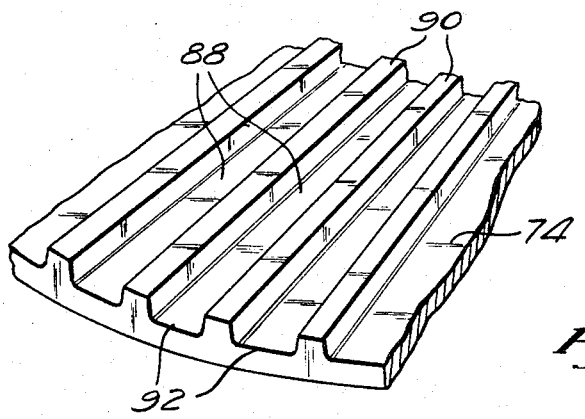
Fig. 9c

Fig. 15
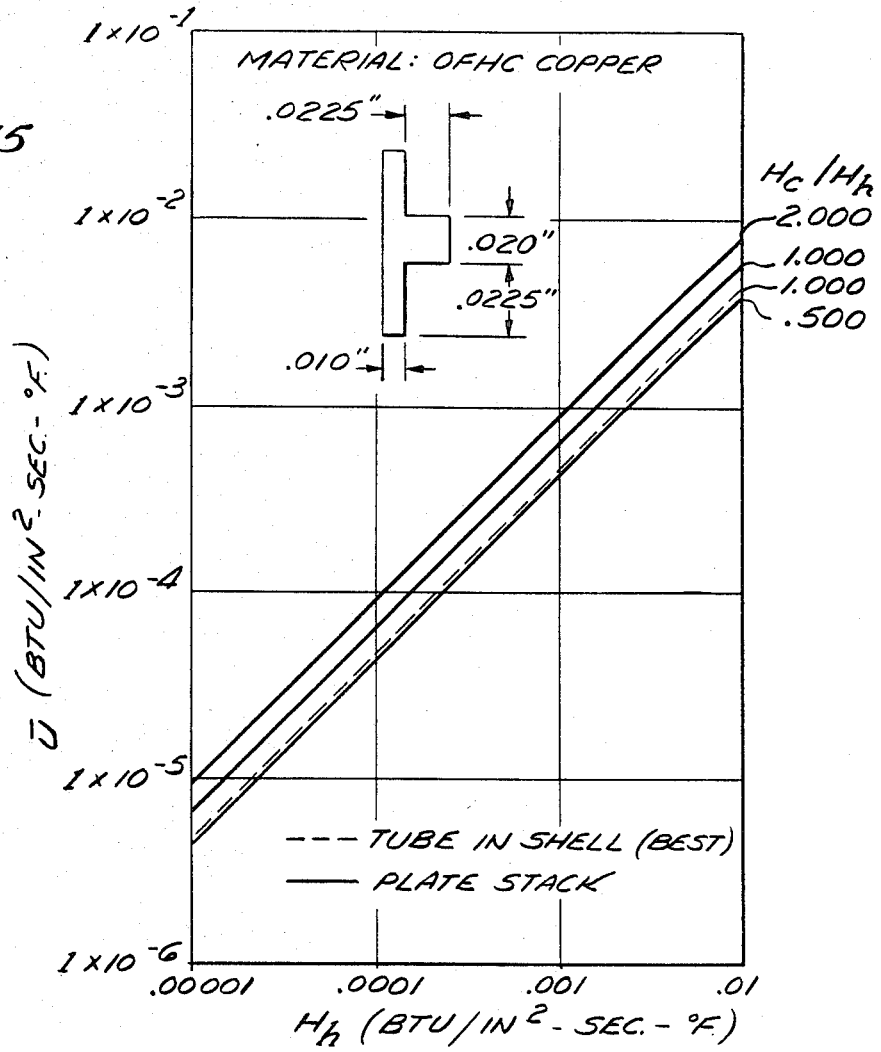
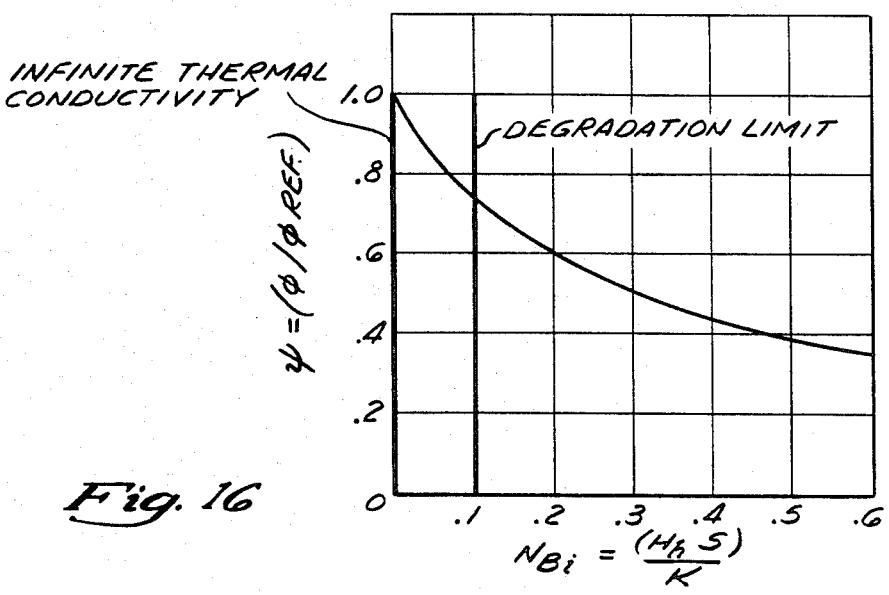
Fig. 16

INTERNALLY MANIFOLDED UNIBODY PLATE FOR A PLATE/FIN-TYPE HEAT EXCHANGER

This is a division of application Ser. No. 080,877, filed 10-1-79 now U.S. Pat. No. 4,347,896.

BACKGROUND OF THE INVENTION

1. Field of the Invention

This invention relates to plate/fin-type heat exchangers, and more specifically, to a unibody open-faced plate for plate/fin-type heat exchangers using countercurrent or parallel flow.

2. Description of the Prior Art

The plate/fin-type heat exchangers are mainly of the channel and rib type construction. Countercurrent flow can be achieved; however, manifolding a plate stack which must separate the fluids at entry and exit becomes extremely complex. In that manifolding of the crosscurrent heat exchangers is comparatively simple, this heat exchanger system is more widely used although it is less efficient than the countercurrent system and it induces serious thermal and mechanical stresses.

One countercurrent system which has attempted to solve the manifolding problem of the countercurrent heat exchanger is taught by Campbell et al, U.S. Pat. No. 3,305,010. Campbell et al teach a heat exchanger having superposed stacked plate and fin elements and complex manifolding means for introducing fluids of different temperatures into opposite ends of the assembly. However, Campbell et al do not teach a plate which serves as both the plate and the fin, nor does Campbell et al teach means for internally manifolding the plate within the plate's plane.

Another countercurrent system, FIG. 1, is that of Alfa-Laval described in the Proceedings of the 5th OTEC Conference, Miami, Fla. (February 1978) Pages VI 288–320. The Alfa-Laval concept consists mainly of a pack of thin metal plates, a frame and means of keeping the pieces together. The plates are suspended between horizontal carrying bars at top and bottom and compressed against the stationary frame plate by means of tightening bolts and a movable pressure plate. The frame plate is equipped with nozzles for inlet and outlet connections. Every plate is sealed around its perimeter with a gasket and cemented into a pressed track. Flow ports at each of the plate corners are individually gasketed and thus divide the interplate spaces into two systems of alternating flow channels. Through these, the two media pass, the warmer medium giving up heat to the cooler by conduction through the thin plates. This gasket arrangement eliminates the risk of media interleakage. The plate, which is the basic element of this concept, has a corrugated pattern stamped on it. These corrugations can be arranged to create an unlimited number of plate patterns. The specific pattern results from a careful trade-off between pressure drop and convective heat transfer characteristics.

The gaskets in the Alfa-Laval system are cemented to the plates in pressed tracks, and are generally made of elastomers like natural rubber, nitrile, butyl, neoprene, viton, etc. The material selection depends upon the working conditions; however, the upper limits are about 360 PSI and about 400° F.

The present invention can be distinguished from that of Alfa-Laval in many ways, some of which include: (1) that the Alfa-Laval system requires gaskets which limit operating pressure and temperature; (2) that the Alfa-Laval system has no contact fins or essential flat plate bottoms for providing the plate-to-plate contact necessary to obtain the optimum heat transfer coefficient; (3) the fact that the inlets and outlets of the Alfa-Laval system are positioned on opposite ends but on the same side of the plate results in a maldistribution of flow across the plate and inefficient heat transfer; and (4) that Alfa-Laval provides no means for driving the incoming fluid across the face of the plate, thereby correcting for their inherent inefficiencies.

Finally, it should be noted that the aforementioned prior art does not teach an annular plate structure nor the plate segment of the present invention.

SUMMARY OF THE INVENTION

Accordingly, there is provided by the present invention an open-faced internally manifolded unibody fin plate for use in a plate/fin-type heat exchanger. Each open-faced internally manifolded unibody fin plate comprises a side port contiguous with an internal manifolding means and wherein the manifolding means is transverse to a plurality of channels, and wherein each channel is contiguous with an end port. A plurality of the open-faced internally manifolded unibody fin plates can be stacked in an opposed manner in an alternating sequence. This internally manifolded plate stack can then be combined with external manifolds to yield an efficient low-cost countercurrent heat exchanger. Another variation of the open-faced unibody internally manifolded plate would include integral auxiliary inlet and outlet manifolds, thereby eliminating the need for separate external manifolding.

OBJECTS OF THE INVENTION

Therefore, it is an object of the present invention to provide an internally manifolded fin plate for use in a plate/fin-type heat exchanger.

Another object of the present invention is to provide a one-piece internally manifolded fin plate for a plate/-fin-type heat exchanger.

Yet another object of the present invention is to provide heat exchanger plates which can be made from a single die.

Still another object of the present invention is to provide a highly efficient countercurrent or parallel flow plate/fin heat exchanger.

Another object of the present invention is to provide high efficiency by having external or auxiliary manifolding which feeds fluid to an internal manifold especially designed to increase the length of fluid current path.

Yet another object of the present invention is to provide low-cost assembly by simple reversal of plates and bonding (diffusion bond, braze, weld) or bolt clamping a set of like plates.

Another object of the present invention is to provide an open-faced fin plate which incorporates a plurality of fin configurations for enhancement of heat transfer through increased surface area and plate-to-plate contact.

Still another object of the present invention is to provide a heat exchanger having simplified auxiliary manifolds.

Yet a further object of the present invention is to provide a simple manifolding means for an internally manifolded plate stack.

Still another object of the present invention is to provide a cost efficient and effective countercurrent or parallel flow heat exchanger.

Another object of the present invention is to provide a heat exchanger having plates relatively free from mechanical and thermal stresses.

Still another object of the present invention is to provide a heat exchanger which can be manufactured inexpensively.

Other objects, advantages, and novel features of the present invention will become apparent from the following detailed description of the invention when considered in conjunction with the accompanying drawings, in which like reference numerals designate like parts throughout the figures.

BRIEF DESCRIPTION OF THE DRAWINGS

FIG. 8*a* is a perspective view of a single internally and externally manifolded plate.

FIG. 8*b* is a perspective view of the open-faced internally manifolded plate stack having side and end manifolds integrally connected with the open-faced internally manifolded plate.

FIG. 9*b* is a schematic cutaway view of the annular open-faced internally manifolded ring structure stack wherein each ring structure comprises a plurality of plates.

FIG. 9*c* is an enlarged fragmentary perspective of FIG. 9*a* showing relative proportions of fins and channels.

FIG. 15 is a graphical representation of the advanced Internally Manifolded Plate Stack (IMPS) overall film coefficient vs gas film coefficient.

FIG. 16 is a graphical representation of performance degradation with Biot Number.

DESCRIPTION OF THE PREFERRED EMBODIMENTS

Figure 1:
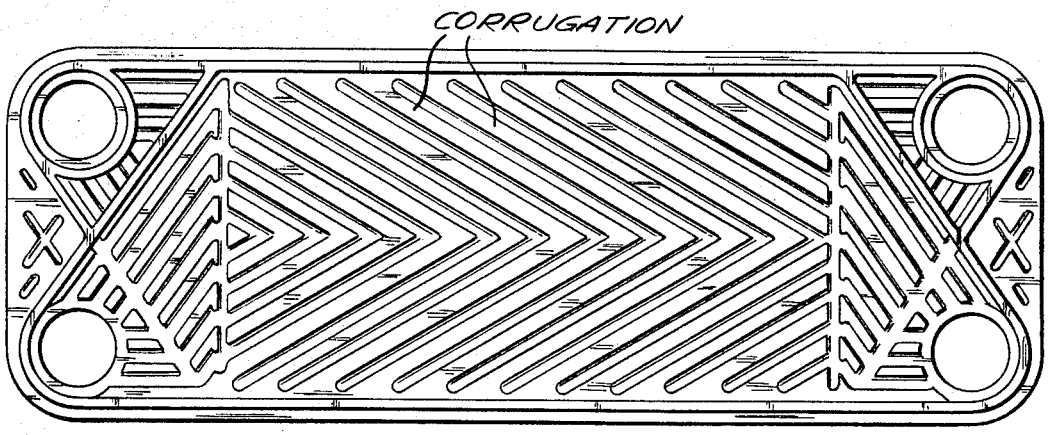
Fig. 1 (PRIOR ART)
FIG. 1 is prior art. It is a top view of the Alfa-Laval corrugated plate.
Figure 2A:
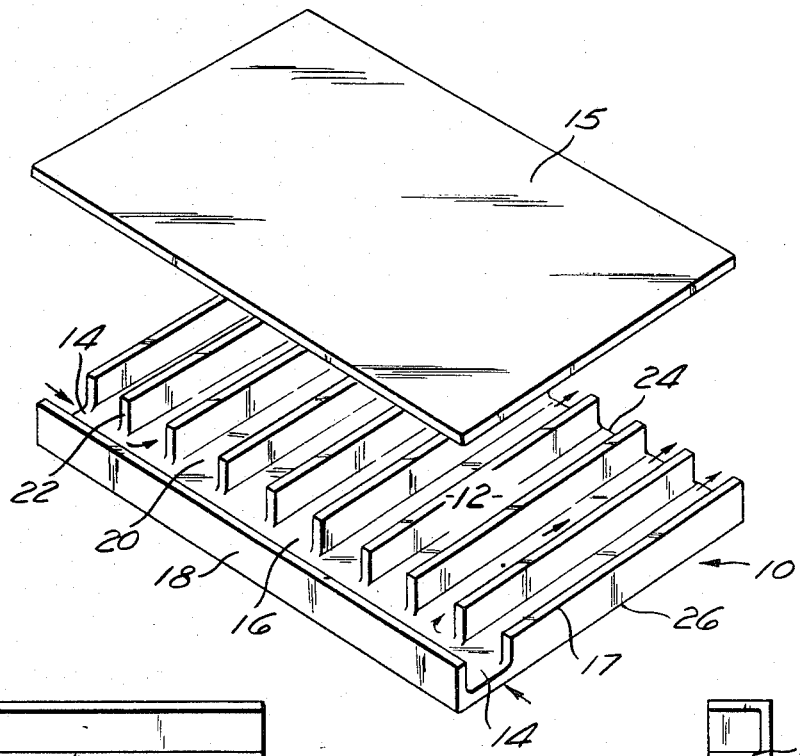
FIG. 2*a* is a perspective schematic view of the open-faced internally manifolded fin plate.
Figure 2B:
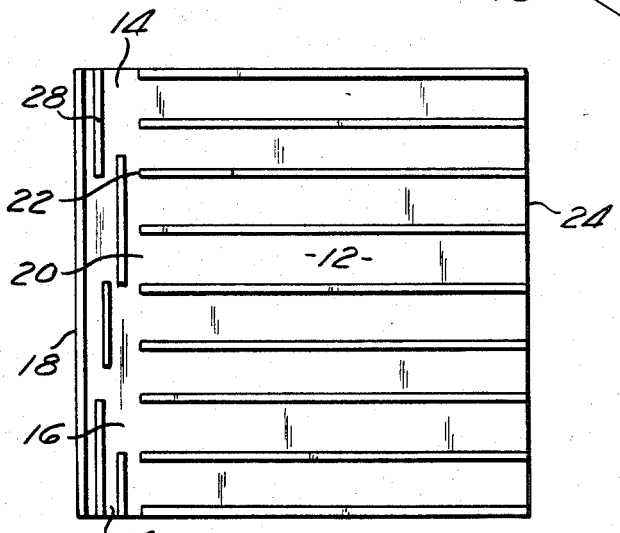
FIG. 2*b* is a top schematic view of the open-faced internally manifolded fin plate.
Figure 2C:
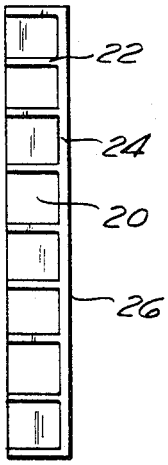
FIG. 2*c* is an open-end schematic view of an open-faced internally manifolded plate.

In accordance with the present invention there is provided an internally manifolded fin plate for a plate/-fin-type heat exchanger. Although it is preferred that plate 10 be of unibody construction, a plurality of components may be connected to make up a single plate. Referring to FIGS. 2*a*, 2*b*, and 2*c*, there is shown the basic unibody, one piece, fin plate 10 which comprises open-face 12, and side ports 14, 14 transversely oriented through top edge 17 of fin plate 10. Side ports 14, 14 are integral, contiguous with, and connected by internal manifolding means 16. Closed end 18 is adjacent to and lateral with the aft end of internal manifolding means 16. Channels 20 formed by fins 22 are contiguous with and transverse to the forward end of the manifolding means 16 and direct fluid flow to end ports 24. Bottom 26 provides a heat transfer surface for connecting to fins 22 of an adjacent plate, a means for separating fluids, as well as a means for sealably connecting the fin plates 10 in a plate stack. It should be noted that the plate stack can be used for high or low pressure situations and that internal leakage paths are non-critical. Plate cover 15 can either be solid, as shown, or merely another basic fin plate 10. Additionally, FIG. 2*b* shows optional manifold fins 28. Manifold fins 28 provide added support and additional means to transfer heat.

Figure 2D:
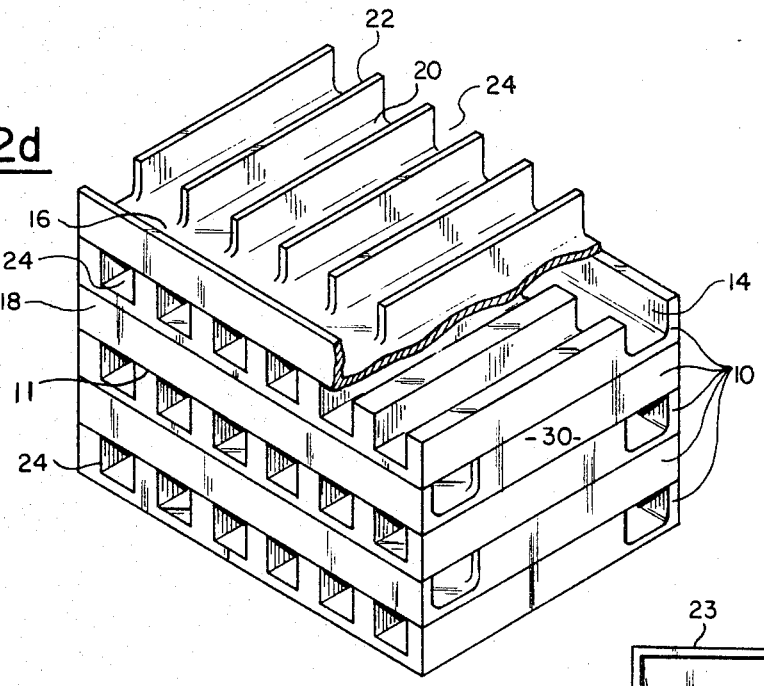
FIG. 2*d* is a perspective schematic view of an open-faced internally manifolded plate stack.
Figure 7A:
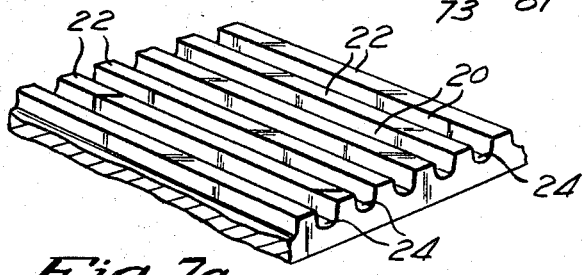
FIG. 7*a* is an enlarged fragmentary perspective showing relative proportions of fins and channels.
Figure 7B:
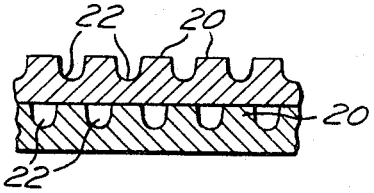
FIG. 7*b* is a schematic view of the plate stack showing the fins in a vertically staggered relationship.

Referring now to FIG. 2*d*, there is shown a schematic representation of an internally manifolded plate stack 30 comprising a plurality of internally manifolded fin plates 10. In the preferred operating condition, fin plates are stacked in an opposed manner in alternating sequence. It should be noted, for each embodiment, that although the fins 22 are shown in a vertical line, they may be staggered, FIG. 7*b*. Also, although in the preferred operating conditions these fin plates are the same, the internal design on alternating fin plates may be varied to accomplish the desired thermodynamic effects. In the preferred operating sequence, a first fluid is conveyed in through side ports 14 of alternating fin plates, into internal manifold 16, along channels 20 formed by fins 22, and exits through end ports 24. A second fluid of either higher or lower temperature is similarly introduced through the side ports 14 of the next alternating fin plate resulting in countercurrent flow. Although this is the preferred direction of flow, it is within the scope of this invention to have flow in a reverse manner where in the fluid enters through end ports 24, flows down the channels 20 into the internal manifold 16, and exits through side port 14. The flow could also be parallel by introducing one fluid through the side port 14 and the other fluid through the end port 24 of the adjacent fin plate. It should be noted that the first and second fluids may be the same or different and that depending upon thermodynamic requirements, more than two fluids may be used.

Figure 3A:
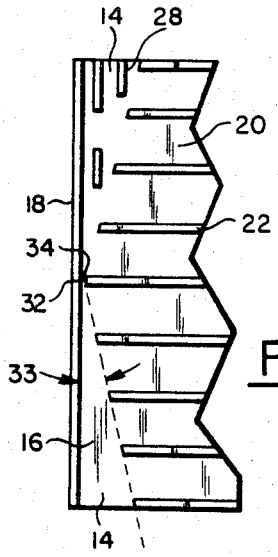
FIG. 3*a* shows an additional schematic embodiment of the internal manifold for the open-faced internally manifolded plate.
Figure 3B:
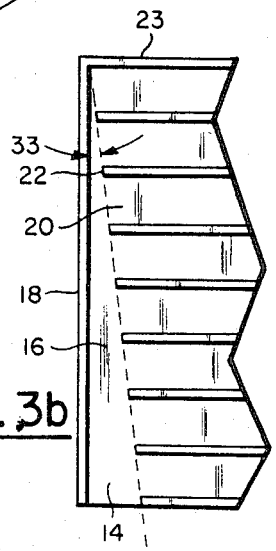
FIG. 3*b* shows another schematic embodiment of the internal manifold for the open-faced internally manifolded plate.

Referring now to FIGS. 3*a* and 3*b*, there is shown two additional embodiments of the internal manifolding means 16. Said manifolding means 16 may have a tapered geometry as defined by an angle 33. In FIG. 3*a*, the internal manifold 16 has two side ports 14, 14 and the taper narrows as the fluid reaches mid-point 32. At mid-point 32 an optional barrier 34 can be inserted. In FIG. 3*b*, the embodiment shows internal manifold 16 having one side port 14 and the taper goes across the full width of the fin plate narrowing as it reaches the closed side 23. Although there are only three internal manifolding geometries displayed herein, any other internal manifold geometry which could channel the fluid from a side port 14 to the channels 20 is within the scope of this invention.

Figure 4A:
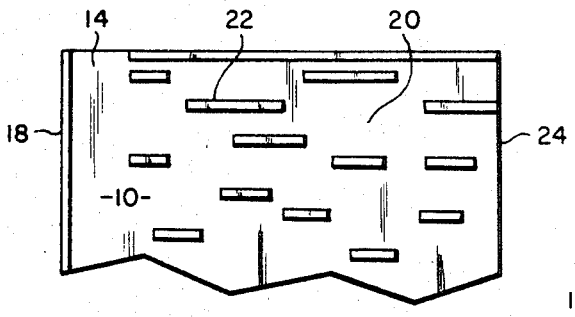
FIG. 4*a* is the top view of another schematic embodiment of the fin-channel configuration.
Figure 4B:
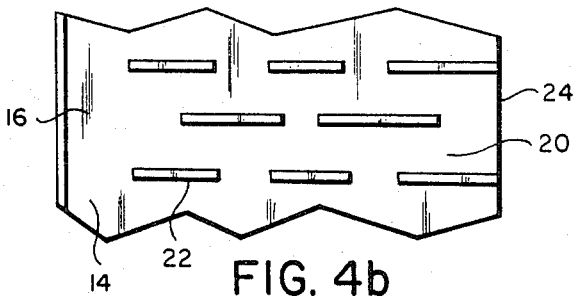
FIG. 4*b* is a top view of yet another schematic embodiment of the fin-channel configuration.
Figure 4C:
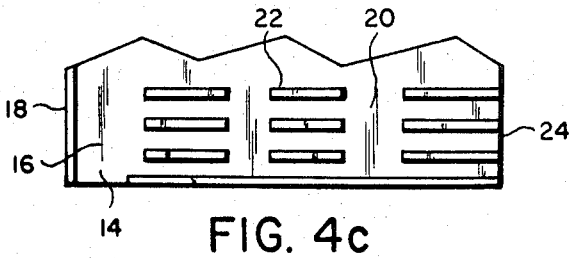
FIG. 4*c* is a third schematic top view of a fin-channel configuration.

Referring now to FIGS. 4*a*, 4*b* and 4*c*, there is shown additional geometries for fins 22 and channels 20. In FIG. 4*a*, the fins 22 and channels 20 are randomly inserted within the main channel 20 of the basic fin plate 10. In contrast to that, fin geometry in FIGS. 4*b* and 4*c* shows inline intermittent fin geometries. Intermittent fin row can either be alternating as shown in FIG. 4*b*, or inline as shown in FIG. 4*c*. The channel surface may be either smooth or rough depending upon the specific design requirements, and it should be noted that no matter what fin geometry is used, the fins and channels are designed to enhance structural integrity as well as overall heat transfer performance. Also, channels may taper in both depth and width.

Figure 5:
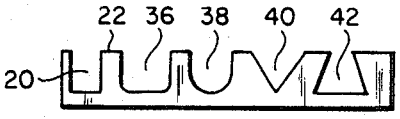
FIG. 5 is a schematic end view of the open-faced internally manifolded fin plate showing various geometries of channels and fins.

Referring now to FIG. 5, there is shown a plurality of channel and fin shapes. The most conventional channel and fin shape is that which is represented by channel 20 and fin 22. However, channels of different configurations such as those with rounded corners 36, U-shaped 38, V-shaped 40, and trapezoidal-shaped 42, along with their respective fin shapes, are also within the scope of the invention. One critical feature of the present invention is that the channel and fins combine to enhance heat transfer and structural integrity while the channel itself is open-faced, thus allowing ease of manufacture. Additionally, it should be noted that the channels themselves may be either smooth or rough, or corrugated or have any other surface geometry which would enhance flow and heat transfer.

Figure 6A:
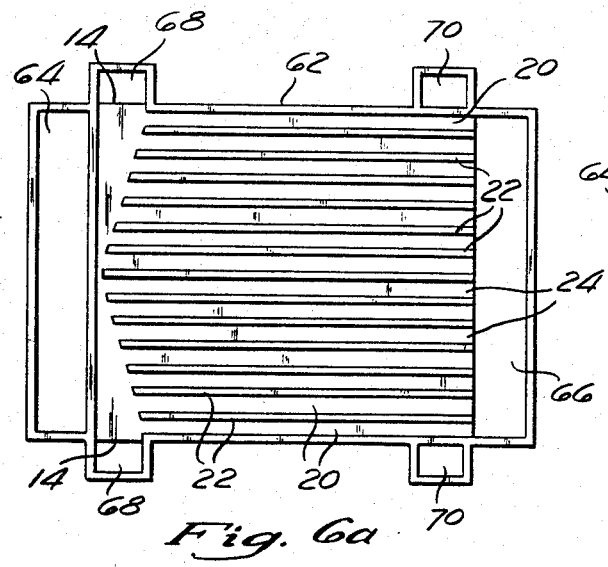
FIG. 6*a* is a schematic top view of an open-faced internally manifolded fin plate having integral external side and end manifolds.

Referring now to FIG. 6*a*, there is shown the top view of the internally and auxiliary manifolded open-faced fin plate 62. Fin plate 62 is basically the same as fin plate 10; however, fin plate 62 additionally comprises closed end external manifold 64, open end external manifold 66, and two pairs of side manifolds 68, 70. Each pair of side manifolds comprise a side inlet manifold 68 and a diagonally located side closed manifold 70. All external manifolds are integral and contiguous with fin plate 10. Although external manifolds are shown with rectangular geometries, any geometry capable of transferring fluid to and from the fin plate will work.

Figure 6B:
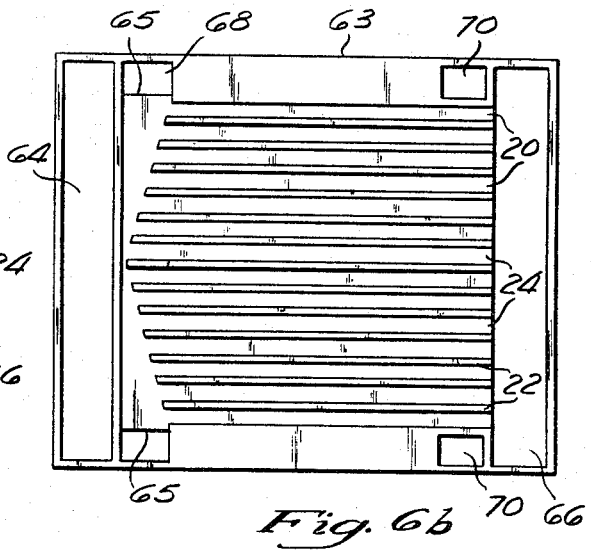
FIG. 6*b* is another schematic top view of an open-faced internally manifolded fin plate having integral interior side and end manifolds.

Referring now to FIG. 6*b*, there is shown the top view of the internally and interiorly manifolded open faced fin plate 63. Plate 63 is basically the same as fin plate 62; however, fin plate 63 additionally comprises closed end auxiliary manifold 64, open end auxiliary manifold 66, two pairs of interior side manifolds 68, 70, and a pair of interior inlets 65. Each pair of interior side manifolds comprise a side inlet manifold 68 and a diagonally located side closed manifold 70.

Figure 6C:
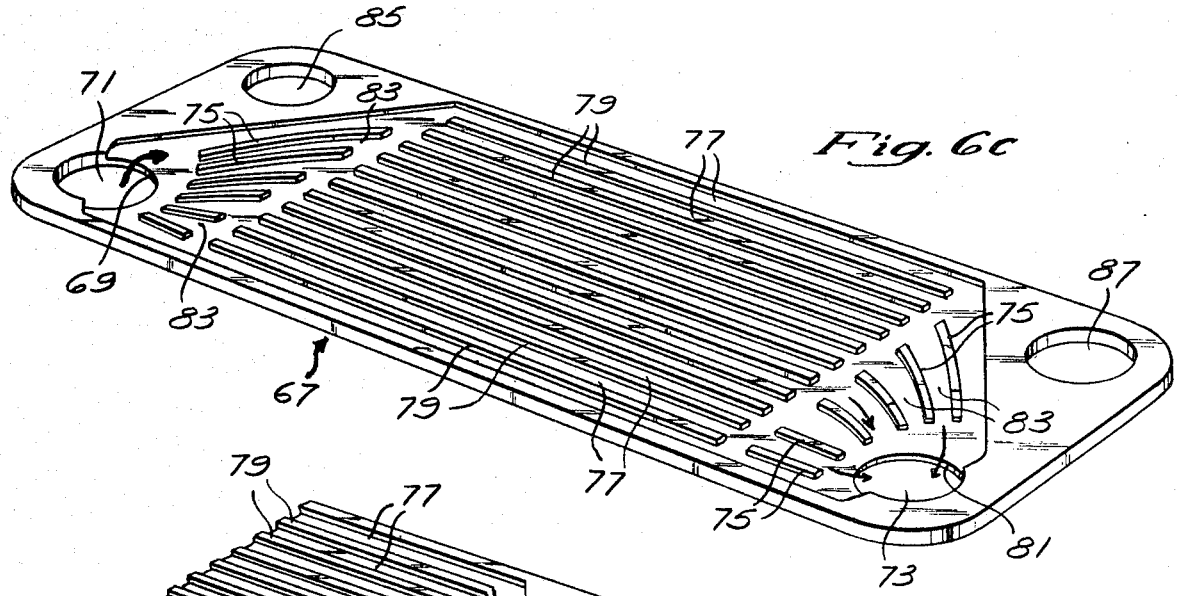
FIG. 6*c* is a perspective view of another embodiment of an open-faced internally manifolded fin plate having integral interior corner manifolds.

Referring now to FIG. 6*c*, there is shown a perspective view of another embodiment of the interiorly manifolded fin plate generally designated 67. Fin plate 67 is basically the same as fin plate 63. However, fin plate 67 comprises: one interior corner inlet 69; and one pair of interior corner manifolds wherein each pair comprises, one interior corner inlet manifold 71 positioned at the interior corner inlet 69, and one interior corner outlet manifold 73 positioned on the same side as inlet manifold 71 but on the opposite end of plate 67. As a heat exchange fluid enters fin plate 67, it flows through open manifold 71 and inlet 69, across internal flow guides 75, down channels 77 defined by fins 79, across open end port 81 and out through interior corner outlet manifold 73. It should be noted that flow guides 75 are similar to manifold fins 28 and serve the same structural and thermodynamic purposes except that as the manifold run increases in length the manifold flow channels 83 increase in width. This design will provide optimum flow distribution across the face of plate 67.

Figure 6D:
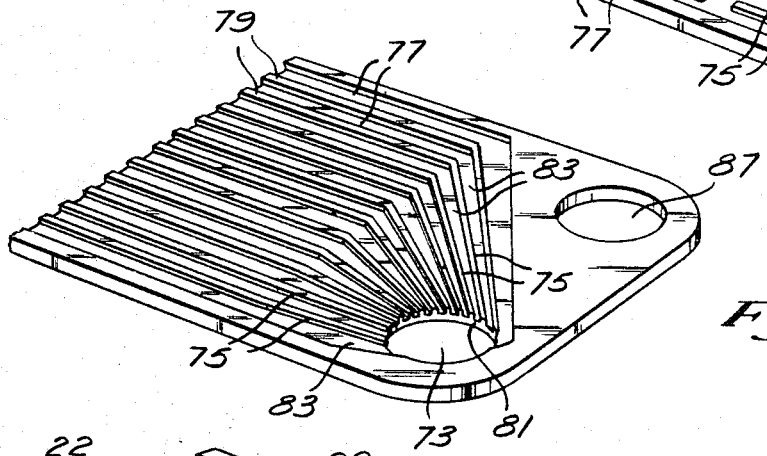
FIG. 6*d* is a top view of another embodiment of the flow guides for the fin plate depicted in FIG. 6*c*.

Another flow guide 75 configuration which would provide optimum flow distribution across the fin plate 67, FIG. 6*d*, entails the use of flow guides 75 designed to feed individual channels 77 by having the flow guides 75 integrally connect with fins 79. As with the set of flow guides depicted in FIG. 6*c*, the spacing 83 between flow guides 75 will increase as the length of the run to fins 79 and channels 77 increases. A pair of tab manifolds 85 and 87 are positioned one each in the remaining two corners of fin plate 67. The tab manifolds 85 and 87 provide the necessary continuous flow passages for fin plates 67 when they are stacked in an opposed manner in alternating sequence.

Referring now to FIGS. 7*a* and 7*b*, and FIGS. 8*a*, 8*b* and 8*c*, there are shown various views of an internally manifolded fin plate and plate stack assembly 72. In the preferred operating condition, fin plates are stacked in an opposed manner in alternating sequence. A first fluid is conveyed to inlet side manifold 68 wherein said fluid flows in through side port 14 along the internal manifolding means 16 and is turned to flow down channels 20 formed by fins 22. This first fluid then flows out end port 24 and into the open end auxiliary manifold 66. From the auxiliary manifold 66 the first fluid is then conveyed to any appropriate location. A second fluid either warmer or cooler than the first fluid is conveyed into the adjacent fin plates through its respective side inlet manifold 68. Then, similarly to the flow of the first fluid, the second fluid is conveyed in through entry port 14 along the internal manifold 16, down channels 20 and along fins 22. From there the second fluid exits into its respective open end secondary manifold 66 where it would be conveyed to any appropriate location. Closed end secondary manifolds 64 and side closed manifolds 70 are used to make continuous secondary manifolds between alternating fin plates. It should be noted that although the side and end manifolds are shown to be rectangular in shape, any functional shape will have the desired effect. Furthermore, heat exchange fluids may be liquids or gases or combinations of liquids and gases.

Figure 9A:
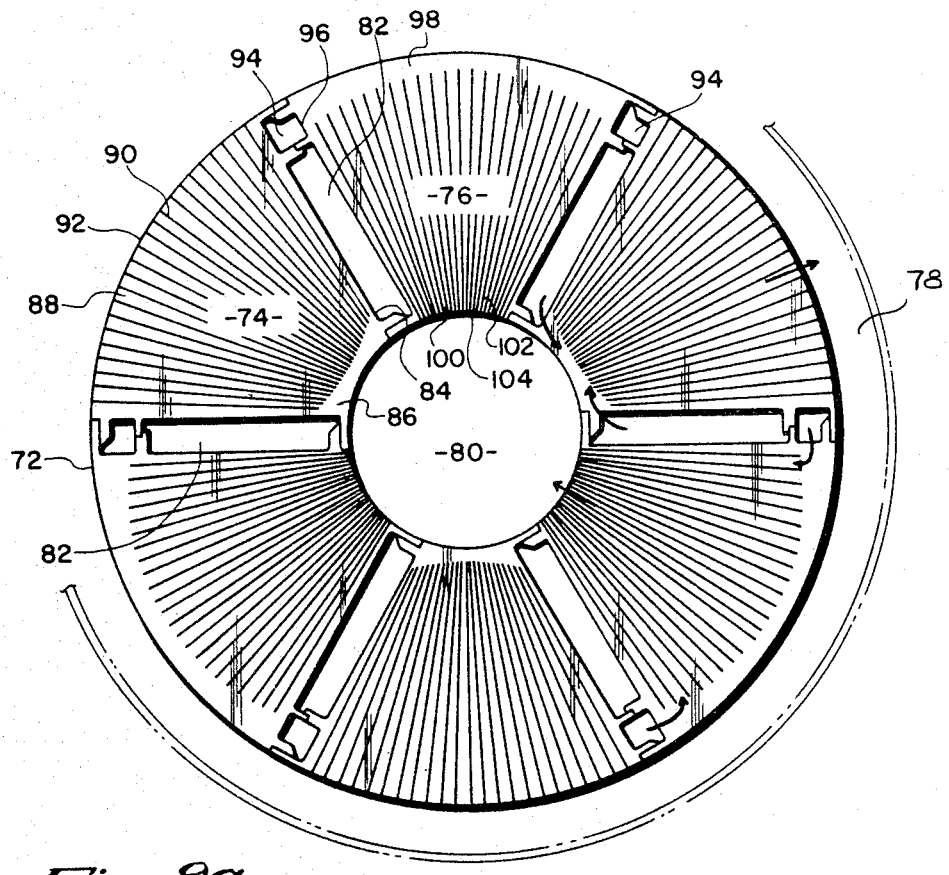
FIG. 9*a* is a schematic of the annular open-faced internally manifolded structure wherein each annular structure comprises a plurality of plates.

Referring now to FIG. 9*a*, there is shown another embodiment of the internally and secondarily manifolded open-faced fin plate. Fin plates 74 and 76 are wedge-shaped and combine through sealable manifolds to make annular structure 72. It should be noted that although the most preferred annular structure 72 is circular, any regular, even-number-sided, annular geometric structure will be preferred, and any annular geometric structure will fall within the scope of the present invention. Representative annular structures include a square, a hexagon, an octagon, etc. Although in its most preferred form there are six interlocking fin plates, this system would work equally well with one or more fin plates. Additionally, some fin plates may not even carry a fluid but may serve as spacers and the like. In its preferred embodiment, annular structure 72 comprises at least one outlet fin plate 74 and one inlet fin plate 76. In operation, a first fluid flows through side inlet manifold 82, in through side port 84, along the internal manifolding means 86 and is turned to flow along channels 88 formed by fins 90. This first fluid then flows out end port 92 on the outer periphery and into the open secondary manifold area 78 where any collecting means will suffice. The first fluid is then conveyed to any appropriate location. A second fluid either warmer or colder than the first fluid is conveyed into the adjacent fin plate 76 by flowing through side inlet manifold 94, through side port 96, along the internal manifold 98, and along channels 100 formed by fins 102. From there the second fluid exits through exit port 104 on the inner periphery and into its respective open end secondary manifold 80. In this particular embodiment, FIG. 9*b* shows a cutaway of an internally manifolded plate stack for generating countercurrent flow. This flow is obtained by alternately superposing fin plate 74 on top of fin plate 76. Any number of annular structures 72 may be stacked depending upon the desired capacity of the heat exchanger. To complete the stack of annular structures, a ring structure-shaped cover plate is sealably connected to the top annular structure of the internally manifolded annular plate stack. It should be noted that the cover plate can merely be another heat transfer annular structure 72. Then, any conventional means for conveying the heat transfer fluid to and from a plate/-fin-type heat exchanger is attached. FIG. 9*c* is an enlarged fragmentary perspective view showing approximate relative proportions of fins and channels.

In its preferred operating conditions, annular structure 72 is made from a plurality of annular segments. In other operating conditions, the ring structure could be of unibody construction and designed to carry one or many fluids. Additionally, the annular stack may be designed to rotate along its axis if the specific design parameters indicated its desirability.

Figure 10A:
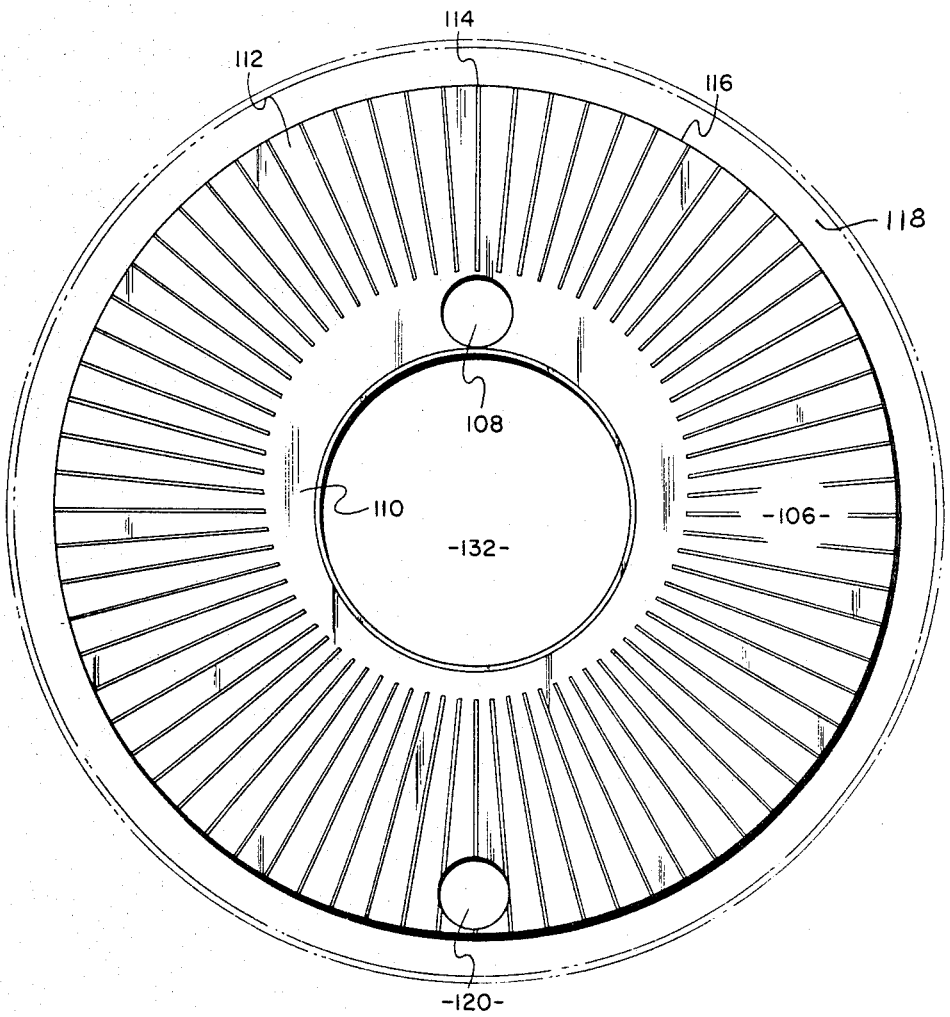
FIG. 10*a* is a schematic top view of an outlet plate for an annular open-faced internally manifolded plate.
Figure 10B:
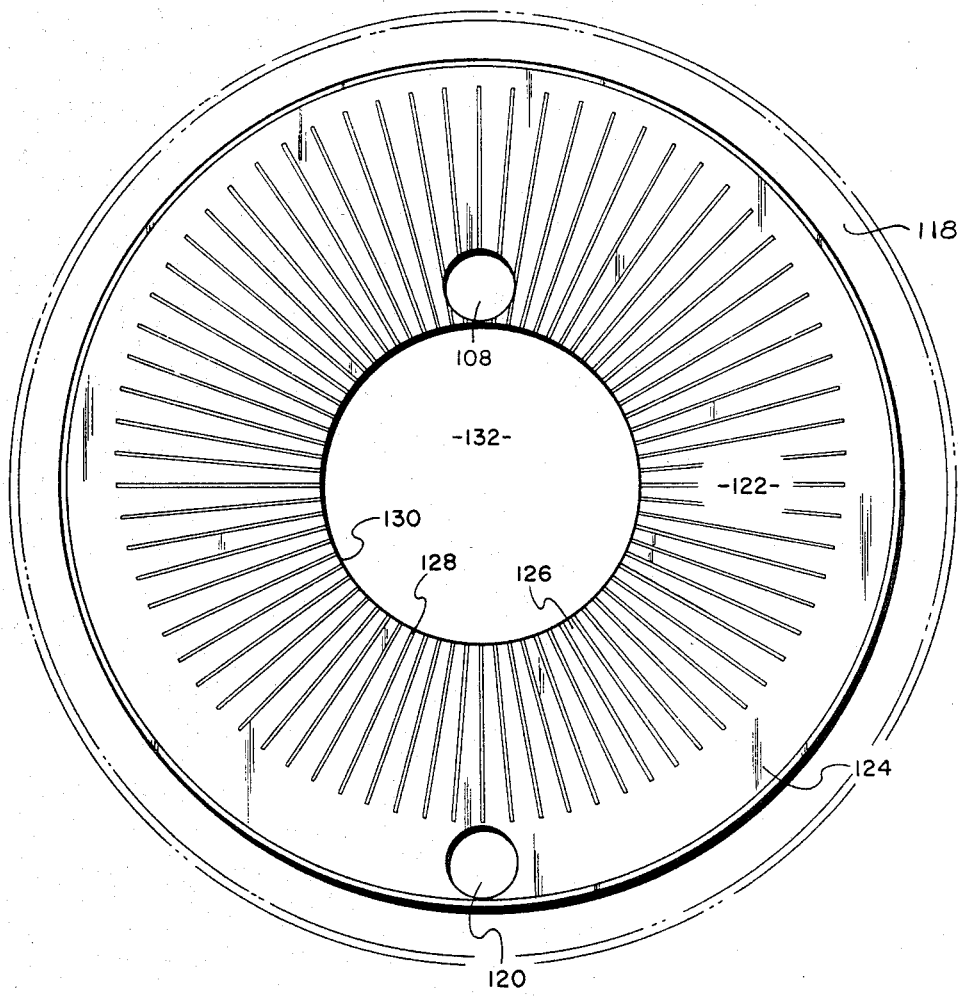
FIG. 10*b* is a schematic top view of an inlet plate for an annular open-faced internally manifolded plate.

Referring now to FIG. 10*a*, there is shown another embodiment of the internally and interiorly manifolded open-faced fin plate. It should be noted that although annular fin plate 106 is circular, any regular annular geometric-shaped plate will fall within the scope of the present invention. Although annular structure 72 is similar to fin plate 106, it should be noted that structure 72 is made up of a plurality of fin plate segments. In contrast to that, fin plate 106 of FIG. 10*a* is a unibody outlet plate. In operation, a first fluid flows through inlet aperture 108 and along the internal manifolding means 110. From there, the first fluid is turned to flow along channels 112 formed by fins 114. This first fluid then flows out end port 116 on the outer periphery and into an open secondary manifold area 118. Interior port 120 is located within the outer periphery of outlet fin plate 106 so as to provide means for channeling the second fluid to the alternating plate. Referring now to FIG. 10*b*, there is shown an inlet fin plate 122. A second fluid, either warmer or colder than the first fluid, is conveyed into fin plate 122 through aperture 120. From there, the second fluid flows along manifold 124 and is turned to flow down channels 126 formed by fins 128. From there, the second fluid exits through exit ports 130 on the inner periphery and into its respective open secondary manifold area 132. Interior port 108 is located within the inner periphery of fin plate 122 so as to provide means for channeling the first fluid to the alternating plate. In this particular embodiment an internally manifolded plate stack of annular configuration is obtained by superposing inlet fin plate 122 and outlet fin plate 106 in alternating sequence to form the desired plate stack height. It should be noted that a plurality of inlets and outlets may be located within each plate if desired. To complete the plate stack, a ring structure-shaped cover plate is sealably connected to the top plate of the internally manifolded annular plate stack. It should be noted that the cover plate can merely be another annular plate or it may be a solid plate. Then, any conventional means for conveying the heat transfer fluid to and from a plate/fin-type heat exchanger can be attached.

Depending upon the ultimate use and the desired heat transfer rate, various plate thicknesses, channel and fin ratios, length and width ratios and various thermally conductive materials can be used. The following materials are delineated by way of example, and not by way of limitation: metals, ceramics, polymers, etc.

The above design is the first real automated means for manufacturing heat exchangers. This will reduce the labour manhours involved in cutting, brazing, welding, leak checking, etc., compared to tube in shell and plate/fin heat exchangers. Moreover, the scaling of the design allowed provides a wide latitude of sizes, materials, and fluids. The following discussion outlines the basis of thermal superiority of the IMPS design over previous design approaches.

Figure 8C:
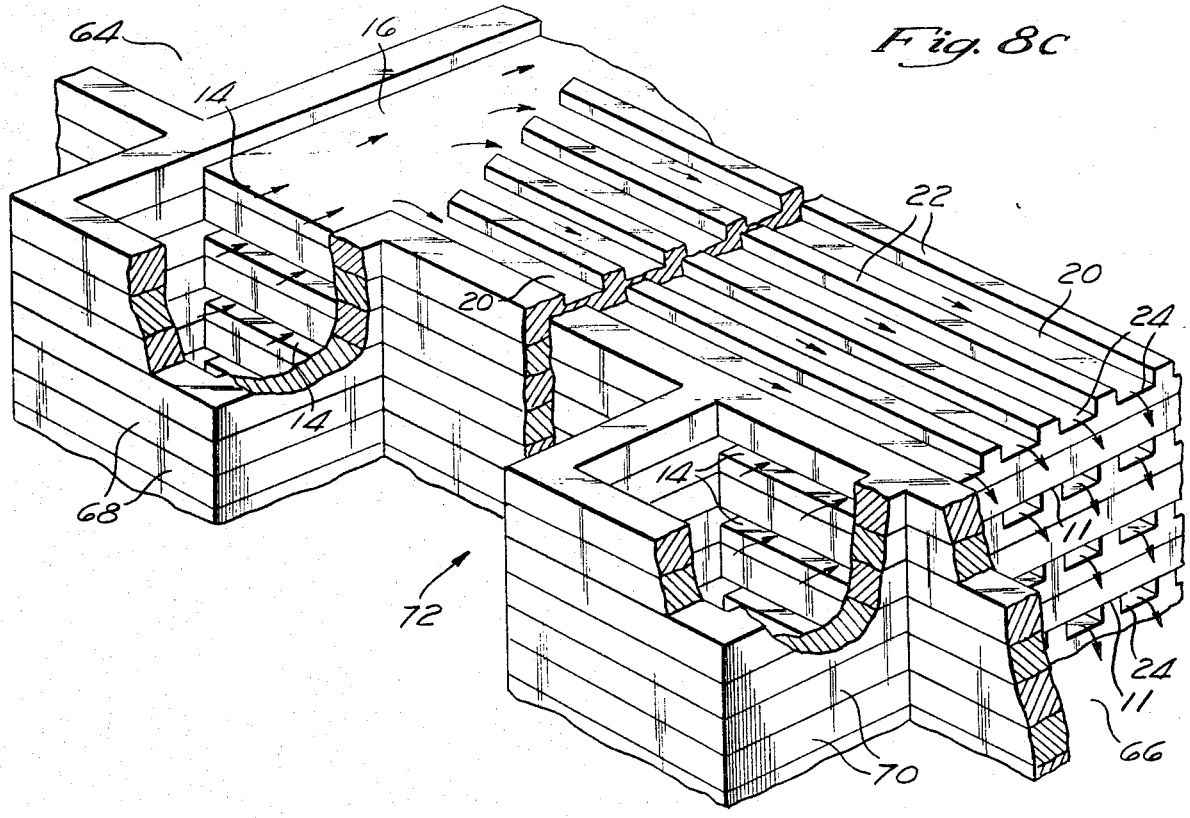
FIG. 8*c* is an enlarged fragmentary perspective showing relative proportions of fins, channels, and manifolding means.

The basic technical merit provided by the design, presented in FIG. 8*c*, is that it allows a fundamental counterflow heat exchange design with all working surfaces having equal $\Delta T$ to the adjacent surface. As can be seen, each passage (cold or hot) has an adjacent passage (hot or cold) on each side. Bonded joint 11 between plates 10, permits the thermal conduction from plate to plate and thereby considerably enhances heat exchanger efficiency over a non-contacting joint design such as the Alfa-Laval concept. The tailoring of the coolant passages to provide variable flow area is allowed in the design, both in width and height with an appropriate change in wall and land thicknesses. In the basic heat exchange process, the best heat exchange efficiency is provided with a pure frictional flow process. Any turbulence due to waviness, protuberances or roughness results in an inefficient pressure loss and an actual decrease in overall heat transfer. If heat exchanger compactness is basically desired, the heat exchange benefit of waviness, roughness, interrupted fins, etc., can be put into the IMPS design by coining, etching, milling, etc., at some expense to the flow pressure losses. The added advantage of a different groove size geometry with simple tooling changes becomes an added feature of the design.

The internal manifolding feature, as shown throughout the Figures, allows for both a minimum flow entrance loss and the internal manifold design provides for heat exchange within the manifold section; thus providing for the highest efficiency in a given length design.

Figure 11:
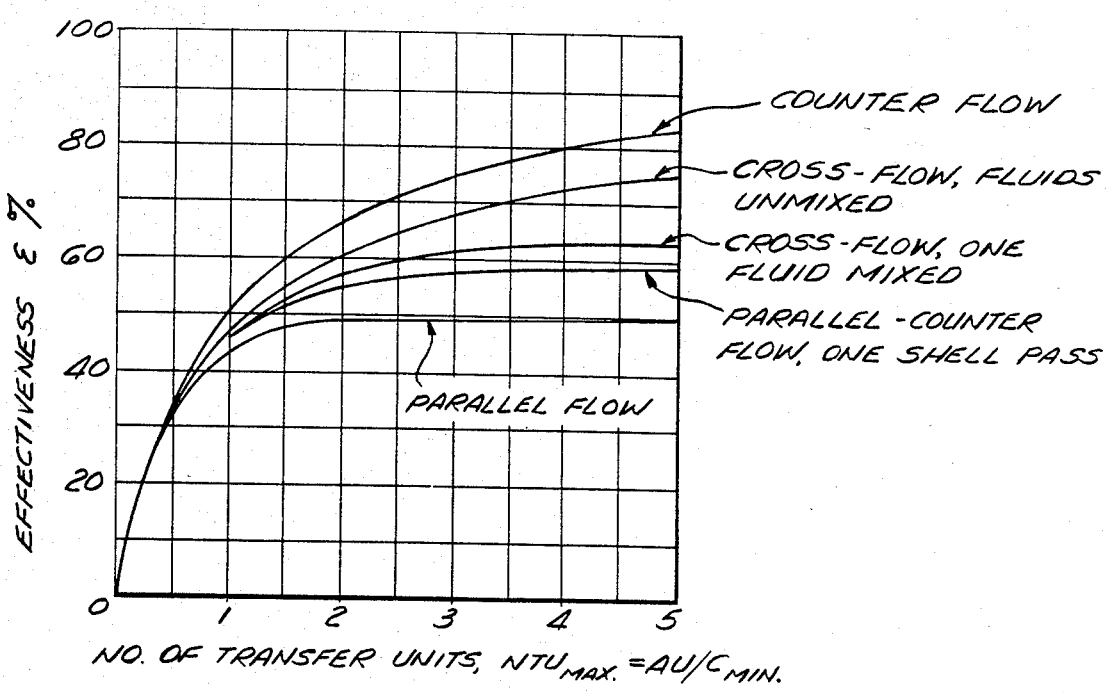
FIG. 11 is a graphical representation showing the effect of flow arrangement on exchanger performance.

Under normal circumstances, the best thermal efficiency is achieved with a good counterflow design. FIG. 11 shows a basic comparison of parallel, crossflow and counterflow designs. It is seen that the efficiency for the parallel flow approaches 50%, crossflow 80%, and counterflow up to 90%, with sufficient length. Since the majority of fin plate heat exchangers are crossflow types because of manifolding reasons, the proposed design shows an intial 10–15% advantage on this basis alone.

The ability to handle either the crossflow or parallel flow case is, however, not excluded with the IMPS design and, alternatively, the use of added cross counterflow fluids and paths is also allowed.

Figure 12A:
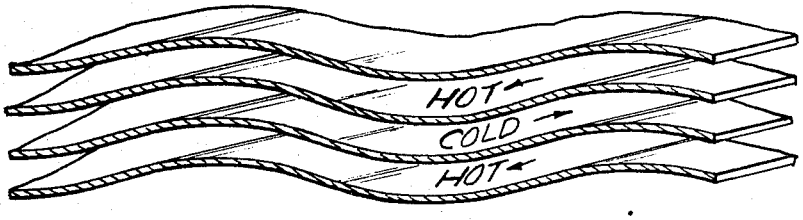
Fig. 12a (PRIOR ART)
FIG. 12*a* is a schematic arrangement of a counterflow-waved wall heat exchanger.
Figure 12B:
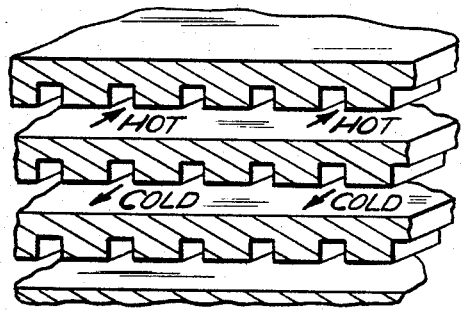
Fig. 12b (PRIOR ART)
FIG. 12*b* is a schematic arrangement of a counterflow ribbed fin plate exchanger.
Figure 12C:
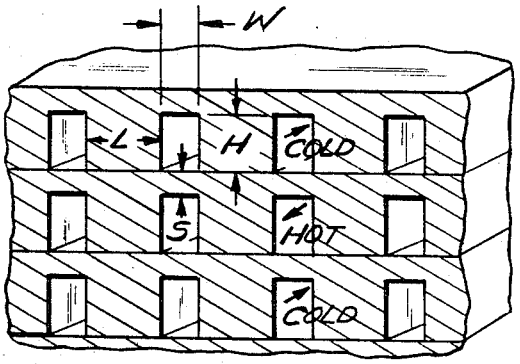
FIG. 12*c* is a schematic arrangement of a counterflow plate stack heat exchanger.

Three distinct heat exchanger examples are shown in FIGS. 12*a*, 12*b*, and 12*c*. All three designs represent counterflow designs which, as described, represent the best heat transfer efficiency approach.

In FIG. 12*a*, for a corrugated or wave shape wall design, the effect of the waves will be to add turbulence which will enhance the heat transfer, but at great expense on the pressure drop due to aerodynamic head loss effects, rather than pure friction. As also shown, unless the surface alignment and spacing is equally matched between cold and hot side surfaces, correctly, inadvertent pressure loss and nonefficient heat transfer would occur. Moreover, no conduction between plate to plate in the assembly can occur in this design.

In FIG. 12*b*, a counterflow ribbed fin plate is illustrated. It has the benefit of extended fin surfaces but not the effect of thermal conduction plate to plate. Moreover, the spacing of the passages is such that only low pressure differentials can be supported between plates and as a consequence, heat transfer rates vary from plate to plate and along and across any given plate surface area.

The proposed plate stack design, FIG. 12*c*, heat exchanger provides for the optimum counterflow design together with extended surface finned construction and no corrugations (if minimum pressure loss is desired). Moreover, a principal advantage is the intimate thermal joint provided by the plate stack which provides for thermal improvements for (almost) all circumstances. For tall height passage designs where the heat transfer coefficients are small compared to the ratio of the material thermal conductivity to mean characteristics height (i.e., $N_{Bi} \leqq 1.0$) the plate-to-plate contact will mean the benefit of the superior thermal conduction of the metal not only between two adjacent plates but from other plates far removed from the immediate thermal joint. In this manner, the added ability of the design to improve heat conduction, results from the three-dimensional thermal conduction within the plate stack. Moreover, the better 3-D thermal conduction in the design also reduces the peak thermal stresses by the proportionate reduction in peak surface temperatures within the exchanger.

The benefit of the plate-to-plate contact can be expressed by an enhancement ratio:

$$\delta = \frac{K}{hS'}\left(\frac{L}{L+W}\right) \qquad \text{Eq. 1}$$

where K is the material conductivity, h is the average heat transfer coefficient, L is the land width and W the channel width. The value S' is approximately the wall thickness S plus $\frac{1}{2}$ of the channel height. From the above formula, it can be seen that values of $\delta$ greater than 1.0 show a benefit for attachment plate to plate. In practice, values of $\delta$ up to 10 times can be realized with proper design geometry. This is especially important where the heat transfer coefficient wants to be low to save pressure drop and pumping power.

Figure 13:
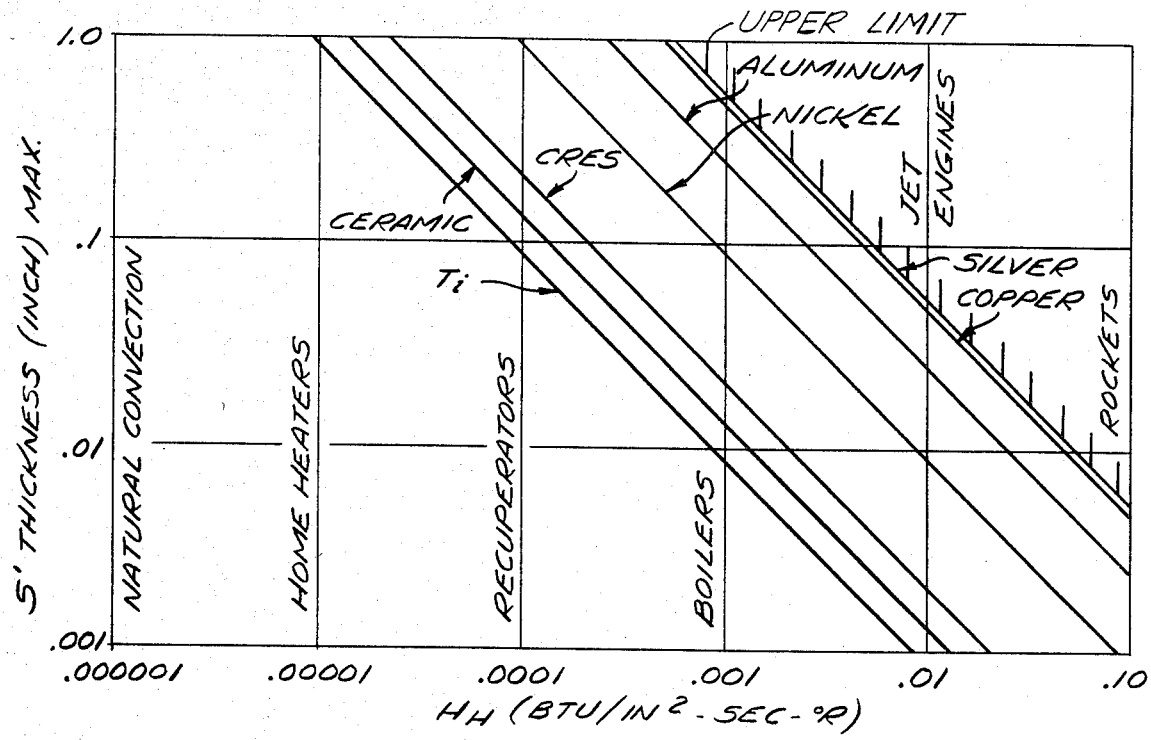
FIG. 13 is a graphical representation of advanced heat exchanger wall thickness limits.

FIG. 13 illustrates for the designs, the requirements of S' vs heat transfer coefficient. For all but the highest heat transfer rate conditions, a practical thickness can be found to use the IMPS plate stack approach.

The overall heat transfer rate q/A for the plate stack heat exchanger on a unit surface area basis between plates may be expressed as (approximately):

$$q/A = \frac{H_h\,\Delta T}{\left(\frac{H_h}{H_c}\right)\left(\frac{L+W}{h+W}\right)_h + \left(\frac{L+W}{h+W}\right)_h + \frac{H_h}{K}\left(S + \tfrac{1}{4}(h_h + h_c)\right)} \qquad \text{Eq. 2}$$

with more detailed analyses performed by computer solution. For a particular pumping power, allowed the cold side and hot side heat transfer coefficients ($H_h$ and $H_c$) become specified, and the wall heat flux can be optimized by the geometry and material selection.

The ratio of heat transferred by the plate stack heat exchanger to a reference plane wall design (Eq. 2, tube in shell) becomes:

$$\phi = \frac{q/A}{(q/A)_o} = \frac{\left(1 + \frac{H_h}{H_c} + \frac{H_h S}{K}\right)}{\left(\frac{L+W}{h+W}\right)_h + \frac{H_h}{H_c}\left(\frac{L+W}{h+W}\right)_c + \frac{H_h(S + \frac{1}{4}(h_h + h_c))}{K}} \qquad \text{Eq. 3}$$

For nearly equal values of cold (c) and hot (h) heat transfer coefficients and a high conductivity (K) wall, this ratio ($\phi$) reduces to:

$$\phi = \frac{2}{\left(\frac{1+L/W}{1+h/W}\right)_c + \left(\frac{1+L/W}{1+h/W}\right)_h}, \quad H_h/H_c = 1.0, \quad K = \infty \qquad \text{Eq. 4}$$

Next, for equal cold and hot side geometries and narrow land to channel widths, this becomes:

$$\phi_{MAX} = \left(1 + \frac{h}{W}\right) \text{ (maximum } \phi \text{ value)} \qquad \text{Eq. 5}$$

As a result, as shown in the next discussion, this bounds the theoretical heat exchange enhancement ratio limit.

For varius situations of cold and hot side heat transfer coefficients and materials and realistic geometries, the use of either Equation 3 or exact computer solutions must be performed.

Figure 14:
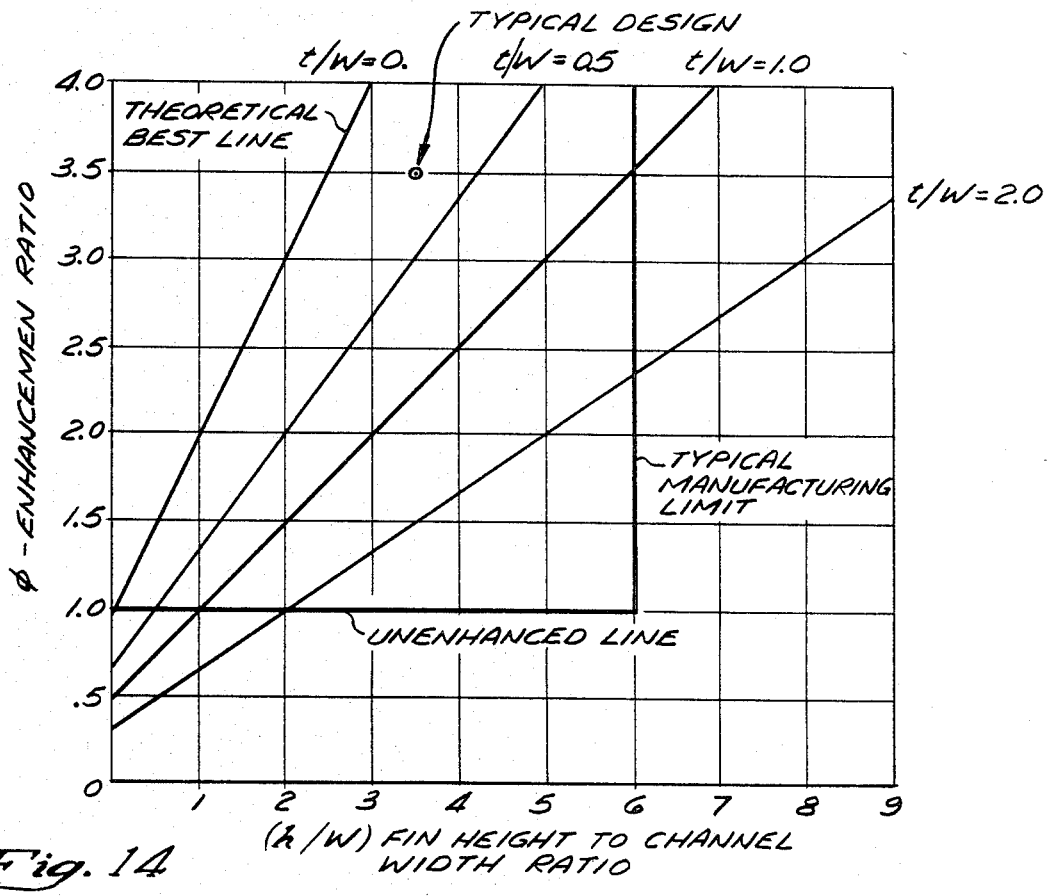
FIG. 14 is a graphical representation of the theoretical enhancement ratio vs fin height-to-width ratio.

The maximum theoretical thermal enhancement ratio that can be provided by the plate stack approach may be seen in FIG. 14. The value $\phi$ represents the enhancement to be obtained by a high conductivity material (copper or silver) as an example. A value of $\phi = 1.0$ represents a normal (e.g., tube in shell) baseline heat exchanger design. Added limit boundaries are shown for the theoretical best line and a (typical) maufacturing limit line. It is shown that typical values of 3 to 4 times the tube-in-shell heat transfer coefficients will occur with a typical design for the same heat transfer coefficient (equal pumping power). Values of $\phi$ at 10 times or greater the baseline heat exchange values can be foreseen under some projected circumstances with equal power loss.

FIG. 15 illustrates for a particular example design recuperator geometry a plate stack computer design analysis with a nominal $\phi$ value of 1.4, i.e., 40% better than the tube-in-shell. As illustrated, the plate stack design can alternatively reduce the required cold side heat transfer coefficient to 50% of the tube-in-shell value (25% of original pumping power).

For lower thermal conductivity materials, a degradation will occur in performance as shown in FIG. 16. For $\psi$ (degradation factor) values in the range $0 \leqq \cap \leqq 0.1$ a minimum degradation is shown. This implies the sizing of the plate stack heat exchanger to ensure the material chosen and the thickness values are satisfactory compared to the lowest heat transfer coefficient in the stack (cold or hot side).

For equal cold and hot side plate geometry situations, for example, the use of several derived parameters can be of importance (These can also be derived for situations of unequal geometry. These are stated as follows:

$$\frac{\text{Surface Area per Unit Volume}}{\text{Weight Per Unit Volume}} \qquad \beta = \frac{2}{W}\left(1 + \frac{W}{H}\right) \qquad \text{Eq. 6}$$

$$\frac{\text{Flow Area Per Unit Frontal Area}}{\text{Weight Per Unit Volume}} \qquad \alpha = \frac{1}{\left(1 + \frac{L}{W}\right)\left(1 + \frac{S}{H}\right)} \qquad \text{Eq. 7}$$

-continued $$\gamma = \rho\left[1 - \frac{1}{\left(1 + \frac{S}{H}\right)\left(1 + \frac{L}{W}\right)}\right] \qquad \text{Eq. 8}$$

These parameters are of importance for design of heat exchange rate, pumping power, and weight (cost) respectively, to assist in design detailing.

Obviously, many modifications and variations of the present invention are possible in light of the above teachings. It is therefore to be understood that, within the scope of the appended claims, the invention may be practiced otherwise than as specifically described.

What is new and is desired to be secured by Letters Patent of the United States is:

1. An annular structure for a plate/fin-type heat exchanger, comprising:

at least one open-faced inlet plate wherein said plate comprises:

an inlet plate having an inner and an outer periphery, for channeling a fluid;

at least one side port adjacent to the outer periphery of said plate and transversely oriented through the top edge of said open-faced inlet plate;

one pair of integral external side manifolds for each side port, wherein one external side manifold is positioned at said side port and the second integral external side closed manifold is diagonally positioned on the opposite side wall;

means for internally manifolding, wherein said means are contiguous with said side port and adjacent to the outer periphery of said inlet plate;

a closed end coincidental with said outer periphery of said inlet plate;

a plurality of contact fins and channels for directing fluid flow and for enhancing heat transfer, and wherein each of said plurality of contact fins and channels are contiguous with, in the plane of, and radially extending from said means for internally manifolding;

an open end port contiguous with said contact fins and channels; and a bottom for mating with an open face of a superposed outlet plate;

one open-faced outlet plate for each inlet plate, wherein said outlet plate comprises:

an outlet plate having an inner and an outer periphery for channeling a fluid;

at least one outlet plate side port adjacent to the inner periphery of said outlet plate and transversely oriented through the top edge of said open-faced outlet plate;

at least one pair of integral external side manifolds wherein one external side manifold is positioned at said outlet plate side port and the second integral external side closed manifold is diagonally positioned on the opposite side wall;

means for internally manifolding said outlet plate, wherein said means for internally manifolding said outlet plate are contiguous with said outlet plate side port and adjacent to the inner periphery of said outlet plate;

a closed end coincidental with said outer periphery of said outlet plate;

a plurality of outlet plate contact fins and channels for directing fluid flow and for enhancing heat transfer, and wherein each of said plurality of outlet plate contact fins and channels are contiguous with, in the plane of, and transverse to said means for internally manifolding said outlet plate;

an open end port contiguous with said outlet plate contact fins and channels; and a bottom for mating with an open face of a superposed inlet plate; and means for sealably connecting said inlet and said outlet plates through their respective integral external side manifolds so as to form said annular structure.

2. The annular structure of claim 1 wherein said inlet and outlet plates are unibody plates.

3. The annular structure of claim 1 wherein each inlet and outlet plate has two sides and wherein each side has one side port.

4. The annular structure of claim of claim 1 wherein there are two pairs of said integral external side manifolds for each inlet plate and two pairs of integral external side manifolds for each outlet plate.

5. A heat exchanger comprising an externally and internally manifolded annular stack, wherein said annular stack comprises:

a cover plate; and a plurality of externally and internally manifolded annular structures stacked out of phase and in alternating sequence, and wherein each annular structure comprises:

at least one open-faced inlet plate, wherein said plate comprises:

an inlet plate having an inner and an outer periphery, for channeling a fluid;

at least one side port adjacent to the outer periphery of said plate and transversely oriented through the top edge of said open-faced inlet plate;

one pair of integral external side manifolds for each side post, wherein one external side manifold is positioned at said side port and the second integral external side closed manifold is diagonally positioned on the opposite side wall;

means for internally manifolding, wherein said means are contiguous with said side port and adjacent to the outer periphery of said inlet plate;

a closed end coincidental with said outer periphery of said inlet plate;

a plurality of contact fins and channels for directing fluid flow and for enhancing heat transfer, and wherein each of said plurality of contact fins and channels are contiguous with, in the plane of, and radially extending from said means for internally manifolding;

an open end port contiguous with said contact fins and channels; and a bottom for mating with an open face of a superposed outlet plate;

one open-faced outlet plate for each inlet plate, wherein said outlet plate comprises:

an outlet plate having an inner and an outer periphery for channeling a fluid;

at least one outlet plate side port adjacent to the inner periphery of said outlet plate and transversely oriented through the top edge of said open-faced outlet plate;

at least one pair of integral external side manifolds wherein one external side manifold is positioned at said outlet plate side port and the second integral external side closed manifold is diagonally positioned on the opposite side wall;

means for internally manifolding said outlet plate, wherein said means for internally manifolding said outlet plate are contiguous with said outlet plate side port and adjacent to the inner pheriphery of said outlet plate;

a closed end coincidental with said outer periphery of said outlet plate;

a plurality of outlet plate contact fins and channels for directing fluid flow and for enhancing heat transfer, and wherein each of said plurality of outlet plate contact fins and channels are contiguous with, in the plane of, and transverse to said means for internally manifolding said outlet plate;

an open end port contiguous with said outlet plate contact fins and channels; and a bottom for mating with an open face of a superposed inlet plate; and means for sealably connecting said inlet and said outlet plates through their respective integral external side manifolds.

6. The heat exchanger of claim 5 wherein said inlet and outlet plates are unibody plates.

7. The heat exchanger of claim 5 wherein each inlet and outlet plate has two sides and wherein each side has one side port.

8. The heat exchanger of claim 5 wherein there are two pairs of integral external side manifolds for each inlet plate and two pairs of external side manifolds for each outlet plate.

* * * * *